United States Patent [19]

Bourdages et al.

[11] Patent Number: 5,060,755

[45] Date of Patent: Oct. 29, 1991

[54] STEP LADDER FOOT-PLATFORM

[76] Inventors: Julien Bourdages; Anne Roy, both of 10,833 Clark Street, Montreal, Canada, H3L 2S9

[21] Appl. No.: 572,243

[22] Filed: Aug. 27, 1990

Related U.S. Application Data

[63] Continuation-in-part of Ser. No. 429,605, Oct. 31, 1989, abandoned.

[30] Foreign Application Priority Data

Apr. 5, 1990 [CA] Canada ..... 2013985

[51] Int. Cl.[5] ..... E06C 7/16

[52] U.S. Cl. ..... 182/121; 248/238

[58] Field of Search ..... 182/121, 122, 120; 248/238

[56] References Cited

U.S. PATENT DOCUMENTS

| | | | |
|---|---|---|---|
| 2,174,891 | 10/1939 | Maran | 182/121 |
| 3,899,045 | 8/1975 | Geisel | 182/121 |
| 4,482,030 | 11/1984 | Lincourt | 182/121 |

FOREIGN PATENT DOCUMENTS

| | | | |
|---|---|---|---|
| 27267 | 7/1887 | Canada . | |
| 927936 | 5/1947 | France | 182/121 |

*Primary Examiner*—Reinaldo P. Machado

[57] ABSTRACT

A stepladder foot-platform comprising a large flat panel, designed to extend through the plane of the stepladder rungs, on this side as well as beyond this plane, between the frame studs, and to come to flatly abut against the top face of an intermediate rung or step. An anchoring foot is provided to frictionally, releasably, fixedly secure the panel about a horizontal plane in an operative, upright, stepladder position, this foot being secured to a lower step. Sliders also act upon the panel to prevent sliding motion of the panel in its horizontal plane, by fixedly securing same frictionally, releasably to the step onto which it rests. The footplate is characterized in that it enables a person to use it by placing his feet on the panel inwardly as well as outwardly from the ladder plane, in total safety, and in that it clears the stepladder so as not to constitute an obstruction to the free travel of that person ascending or descending that rungs.

5 Claims, 3 Drawing Sheets

STEP LADDER FOOT-PLATFORM

CROSS-REFERENCE DATA

This application is a Continuation-in-Part application of application Ser. No. 07/429,605 filed Oct. 31, 1989, now abandoned.

FIELD OF THE INVENTION

This invention relates to the field of ladders and stepladders, and more particularly to foot-platforms used onto the rungs of ladders to improve the total working area of persons using this stepladder or ladder.

OBJECTS OF THE INVENTION

Ladders such as stepladders are often used by workers, e.g. electricians, during their work, to reach out raised structures. Ladders consist in one pair of side-piece legs or studs interconnected by suitably spaced cross-piece rungs or steps. The ladder studs must abut by their upper ends against a fixed surface to be stabilized, if one wishes to use the ladder. The rungs or stems are generally narrow and cylindrical, so that the user, if he is not made himself firm in his position while hand-grabbing the ground-standing studs, will be prone to become quite rapidly out of balance. What is more, workers often carry about their waistbelt heavy toolbags, wherein a lower level of comfort in the use of the ladder follows.

Moreover, stepladders, which are nothing else than self-standing ladders with two pairs of legs, thus have a tendency to be more stable than ladders; also, the slope of the plane of the steps remains always the same, in the operative (open) stepladder position, and the steps are wider and notably flat on their upper surfaces. On the other hand, it is found that the use of a stepladder nonetheless brings about various side effects to regular users: backpain, increased tiredness, downfall hazards, the increased attention devoted to one's balance on the stepladder reducing the level of concentration for the work to be done, and limited available working area on the steps (one constantly needs to descend, move the stepladder, then to climb again).

In the prior art, there has been developed footplates or pedestals, to be mounted onto the rungs or stems of a ladder, to improve either the balance of the worker or the effective working area. Hence, Canadian patent 27,267 issued in 1887 to Ramsey, does disclose such a foot platform A, to be secured at C onto a first cylindrical ladder rung in an operative inclined ladder position, and to be adjustably supported at C by a telescopic arm connected to a second rung above the first-mentioned one. Pedestal A projects on the side opposite the inclination of the ladder, beyond the vertical plane extending through the ground support studs or legs of the ladder, and the support arm C makes an angle of about 45° with respect to the ladder studs.

In our opinion, a construction as in the Ramsey document is a safety hazard since, in view of the large angle defined between the foot platform and the ladder plane, the ladder may be pivotally biased on its legs, on the side opposite its inclination, yieldingly to biasing load variations produced by the bodily movements of the worker on the platform, and thus the worker could fall down. Moreover, because of the large acute angle between the supporting arm C of the platform and the ladder, the hinge E connecting the arm C to the ladder rung will tend to sustain high sidewisely directed biasing forces, induced once again by the worker bodily movements on the platform. Panel A constitutes also a major obstruction for the worker: it is hard to imagine how the latter could freely ascend the ladder beyond the platform, without first removing brace C; in such a case, for the worker to effect the installation of the platform onto the ladder rungs, he will have to remain in his ascended position on the upper ladder rungs, clearly a safety hazard. Moreover, the ladder inclination in its operative position not being known until the ladder bears against a fixed, upper abutment surface, not only will it be necessary to adjust the length of the supporting brace C, each time the ladder is to be installed or moved on the ground, in order to horizontally adjust the pedestal A, but also, it will not be easy to provide a perfect adjustment wherein in practice, the platform will probably never be perfectly horizontally level, again with the safety hazard associated therewith.

U.S. Pat. No. 4,482,030 issued in 1984 to Lincourt shows a foot-platform 18 mounted onto a first ladder rung 15 and hooked to a second rung overlying the first-mentioned one through anchoring arms 24, 25. The platform 18 projects inwardly of the ladder inclination, contrarily to the Ramsey patent, and thus is safer relative thereto. It is noted however that in FIG. 2 of this patent, although the worker's balance in upright position onto the platform is substantially improved by use of this platform 18, his comfort or working area will not on the other hand be improved since his tibias will abut against the upper flanges 32 of the retaining arms 32 as well as against the step 16 itself.

Clearly, with the opposite inclination of the ladders from these two above-noted patents, the skilled artisan having a low level of imagination could not produce an inventive mosaic with these two documents.

It is also noted that these various paraphernalias apply only to ladders.

OBJECTS OF THE INVENTION

The gist of the invention is to provide a work platform for ladders or stepladders, which enable to substantially improve the balance and comfort of a person standing upright on this platform, as well as to improve the total effective working area.

An object of the invention is to provide a work platform, specifically adapted for use with a stepladder.

A corolary object of the invention is to increase workers' output for those working on stepladders, as well as reducing the occurrence of accidents linked to the use of such stepladders.

A general object of the invention is to provide such a work platform for a stepladder, which is of simple construction and of low manufacturing cost.

Another object of the invention is to produce such a platform for stepladders, which, when mounted to a step, may remain thereon without any problem even when the stepladder is closed or stored.

SUMMARY OF THE INVENTION

In view of the objects of the invention, there is disclosed a stepladder capable of standing in an upright, well-balanced position on the ground and comprising a rigid frame and a series of cross-piece rungs anchored to the frame so as to be spaced and substantially parallel to each other and so as to define a plane forming a large acute angle relative to the ground, said stepladder comprising a large platform supported by an intermediate rung or step and extending through said rung plane so as to project on this side and beyond of the latter plane releasable anchoring means to secure said platform to said intermediate step and to a rung beneath said intermediate step so that the platform be horizontal in said upright position of the stepladder; wherein a person may freely ascend on or descend from each of the rungs of the upright stepladder, even when the platform is installed, and wherein this person may stand on the platform with his feet on this side as well as beyond relative to the plane of these rungs, in total safety, wherein the working area of this person will be maximized and the balance of the stepladder, made firm.

Preferably, said anchoring means of the platform further comprises adjustment means, to adapt to rungs or steps of variable height or thickness.

Advantageously, each step is cross-sectionally quadrangular and wherein each anchoring means comprises a first rigid bar, defining a main section endwisely curved at right angle to form an [, and anchored by its upper flange to the end of the platform opposite the inclination of the steps plane, and freely standing by its lower flange against the upper face of said lower step, and a second L-shape, rigid bar, defining a first leg hooked by a slider to said first bar so as to be slidable therealong, and a second leg abuttable against the underface of said lower step, and locking means to render the slider integral to said two bars.

Profitably, said anchoring means further comprises a first pair of abutment members, secured to the lower face of said platform, on its opposite sides and proximate to the anchoring of said first bar, a second pair of abutment members, mounted to said lower face of said platform respectively in register with said first pair of abutment members, slider means to permit sliding motion of said second abutment members within the axis of said first abutment members in respective register, wherein said intermediate step may extend in between said first and second abutment members, and locking means to lock said second abutment members in position when the intermediate step is taken in sandwich between the abutment members.

The invention relates also to a supporting device to improve the working area and the balance of a person using a ladder maintained in an inclined, operative position above ground, said ladder consisting of two rigid studs, interconnected by a plurality of spaced, cross-piece rungs; said device comprising a large flat panel, capable of extending through the plane of said ladder on this side as well as beyond this plane, between the studs and to come to flatly abut against the top of an intermediate rung of said ladder, first anchoring means to frictionally releasably secure said panel about a horizontal plane in said operative ladder position, and second anchoring means frictionally releasably acting on said panel to prevent sliding motion of said panel within its said horizontal plane; wherein said device permits said person to stand upright on said panel, by positioning its feet on the side of the inclination as well as on the side opposite the inclination of the ladder plane, in utmost security, and wherein said panel and said anchoring means clearing the ladder so as not to constitute an obstruction to the free travel of said person ascending or descending along each of said ladder cross-piece rungs.

Preferably, said rungs constitute steps each having a flat upper surface and wherein said panel anchoring means further comprising adjustment means, to adapt to steps or rungs of variable thickness or height.

Advantageously, each step is cross-sectionally quadrangular and wherein said first anchoring means comprises a first rigid bar, defining a main section endwisely curved at right angle to form an [, and anchored by its upper flange to the end of the panel opposite the inclination of the steps plane, and freely standing by its lower flange against the upper face of a step beneath said intermediate step, and a second rigid L-shape bar, having a first leg retained by a slider against said first bar so as to be able to slide therealong, and a second leg capable of abutting against the top face of said lower step, and locking means to render the slider integral to the two bars.

Profitably, said second anchoring means comprises a first pair of abutment members, secured to the lower face of said panel, on its opposite sides and proximate to the anchoring of said first bar, a second pair of abutment members, mounted to said lower face of said panel respectively in register with said first pair of abutment members, slider means to permit sliding motion of said second abutment members axially of said first abutment member in register therewith, wherein said intermediate step may extend in between said first and second abutment members, and locking means to lock said second abutment members in position when the intermediate step is taken in sandwich between the abutment members.

DETAILED DESCRIPTION OF THE INVENTION

Figure 2:
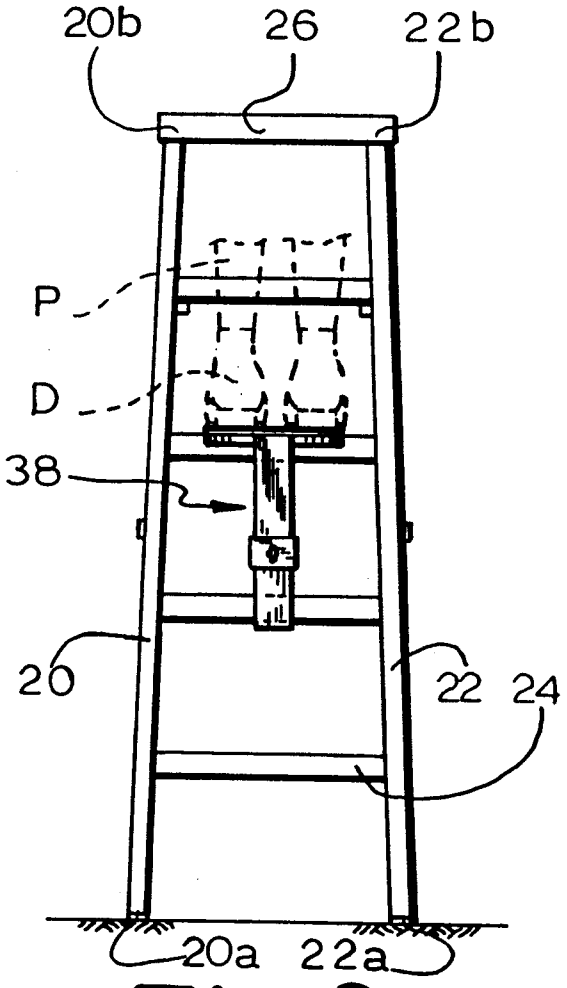
FIG. 2 is a rear elevational view of the stepladder of FIG. 1.
Figure 1:
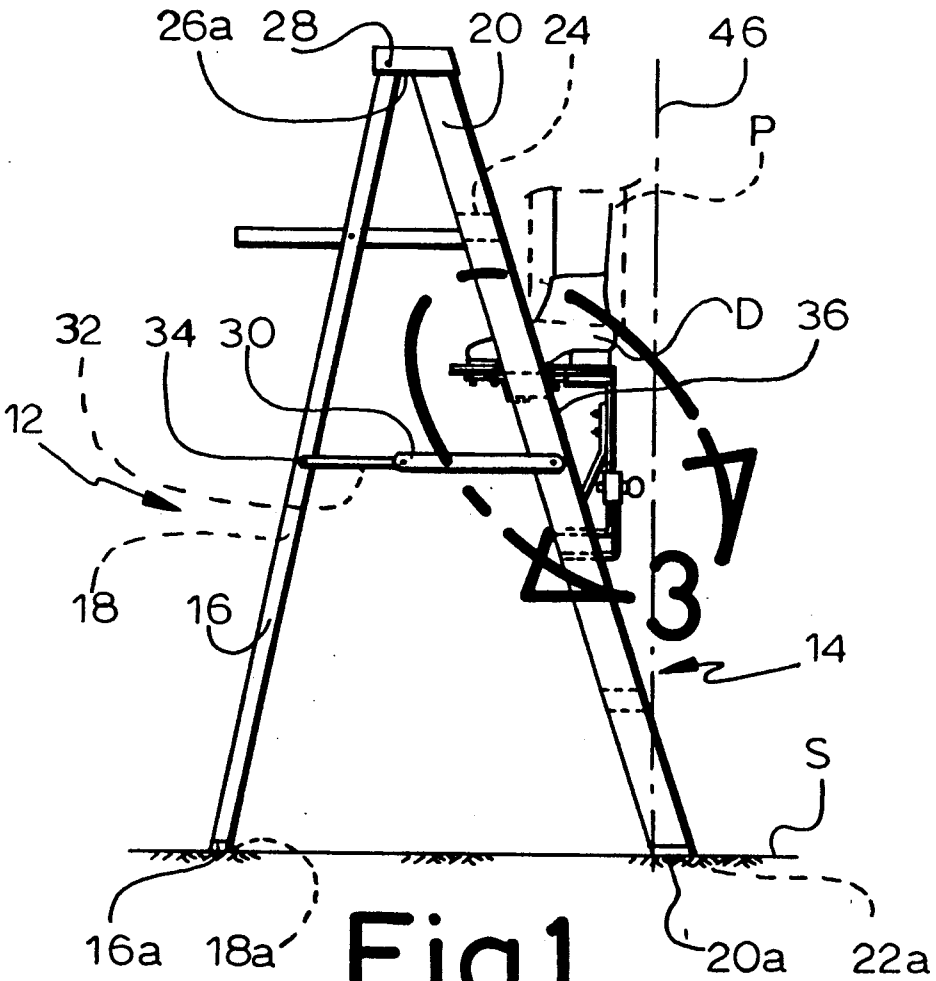
FIG. 1 is a side elevational view of a stepladder, onto which is mounted a foot platform supporting the feet of a person in accordance with the invention.

The stepladder 12 shown in FIGS. 1–2 is of a known construction, generally comprising a rear ladder part 14 and a pair of front, rigid, ground-standing, load-bearing legs 16, 18. The ladder part 14 consists of two sturdy, ground-standing, load-bearing studs 20, 22, spacedly interconnected by transverse cross-pieces or rungs 24 designed to be used as ascending/descending steps. Studs 20, 22 are endwisely secured to a hollow flat block 26, at **20*b*, 22*b*. The legs 16, 18 are themselves pivotally endwisely mounted to the flanges 26*a* of this block 26, thanks to pivotal hinge means 28, so as to enable their pivotal motion about an axis parallel to the plane of the ladder part 14. In their intermediate sections, stud 20 and leg 16 are interconnected by a first connecting rod 30, and stud 22 and leg 18 are interconnected by a second connecting rod 32, about pivotal axes 34, 36, there being one for each connecting rod and parallel to one another and also parallel to the pivotal axis 28 of the legs 16, 18. Connecting rods 30, 32 define a maximum spread-apart position of the legs 16, 18 relative to the studs 20, 22, being usually an acute angle of about 30° or less, so that, once the free bottom ends at 16***a*, 18*a*, 20*a*, 22*a* of the studs and legs bear onto the ground S, the stepladder may be locked into an self-supporting, operative, balanced, opened position, enabling a person P to safely ascend over ground by footwisely engaging at D each of the steps 24, successively, starting from the one nearest to the ground. In so doing, it is necessary that the distance between the anchoring points 20*b*–22*b* be well short of the distance between the legs 16*a*–18*a* and 20*a*–22*a* of the stepladder 12, in its operative position.

Figure 3:
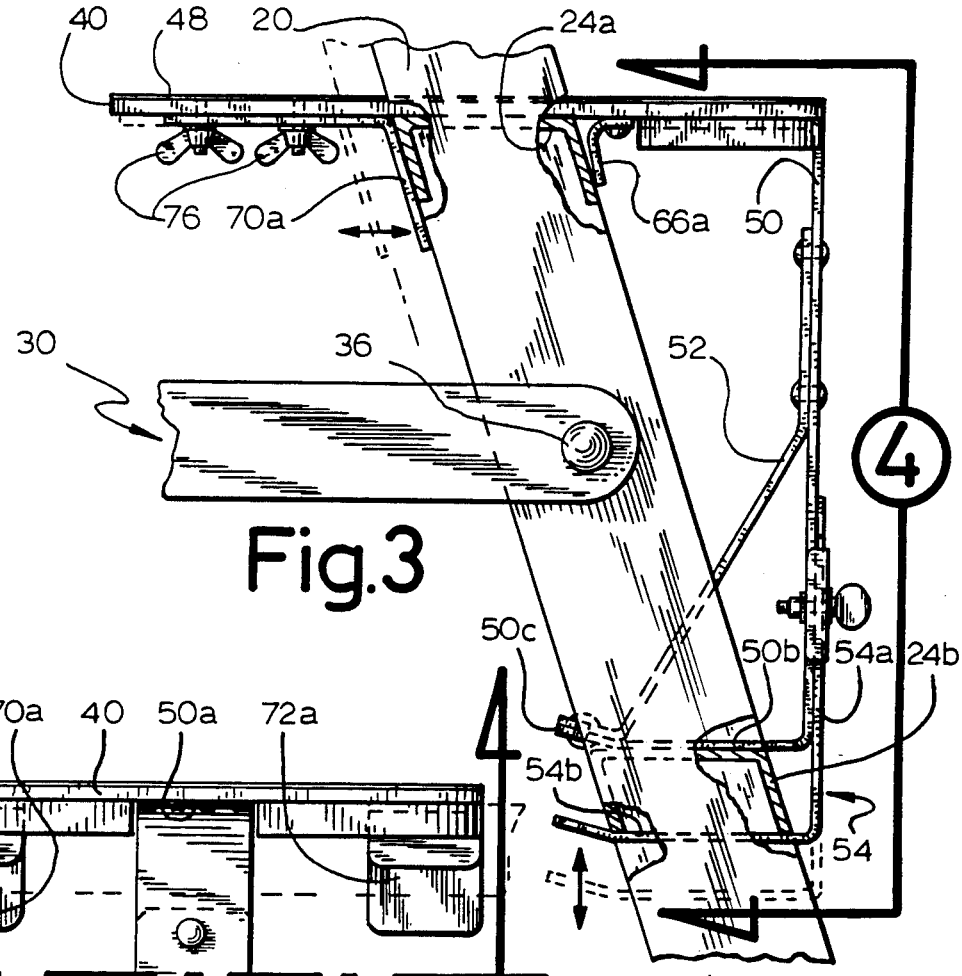
FIG. 3 is a view at an enlarged scale of the area within ellipse 3 of FIG. 1.
Figure 4:
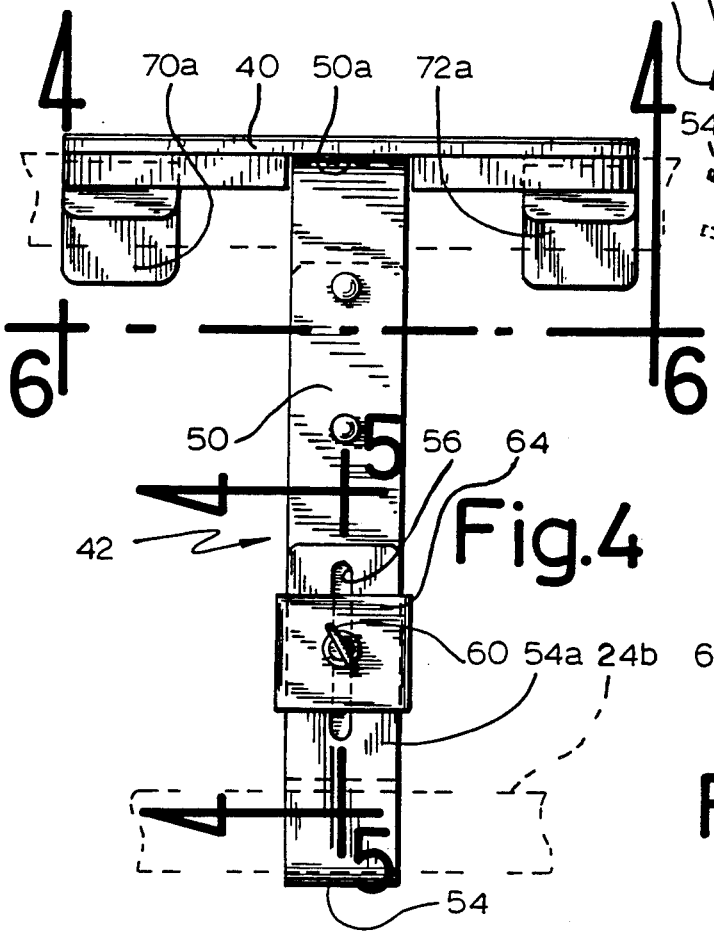
FIG. 4 is an elevational view along perspective 4—4 of FIG. 3.
Figure 5:
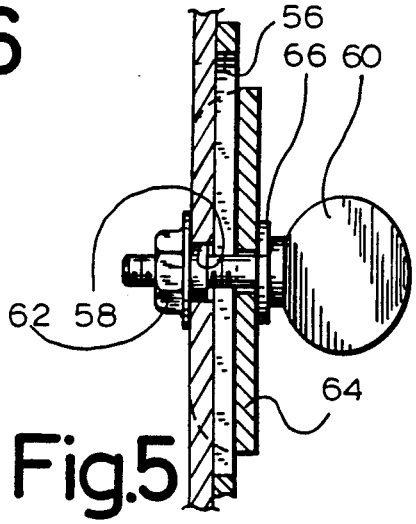
FIG. 5 is a is a sectional view along lines 5—5 of FIG. 4.

Usually, the steps 24 are regularly spaced and will remain in the plane of the ladder part 14. The steps may define a quadrangular shape, e.g. forming a parallelepipede as illustrated in FIG. 3 (the lower step wall may be removed) and their upper flat faces would then be destined to become horizontal when the stepladder stands upright. Block 26 may be used as an upper step, as is known.

Accordingly with the invention, there is provided a foot platform device 38, adapted to be releasably secured above one of the intermediate steps, e.g. 24*a*. The device according to the invention consists of a large rigid panel 40 and of anchoring means 42, 44, to fixedly secure the panel in a plane parallel to the steps 24. Pedestal 40 is designed to flatly abut against the flat top face of one step 24*a*, to support a person's feet D. Pedestal 40 will be much deeper than the step onto which it bears, i.e. that it will extend (rearwardly) well on this side of as well as (forwardly) well beyond the plane of the ladder part 14, so as to support the foot D at least on all its length. However, the outer end 40*a* (rearwardly of the panel) must necessarily remain on this side of the vertical plane 46 (FIG. 1) which extends through the front inner edge of the spread-apart legs 20*a*, 22*a* of the stepladder studs in the stepladder operative open position; otherwise, the stepladder balance of the platform device onto which stands the person p will be compromised, since the center of gravity of the combination worker-stepladder could then be transferred outwardly from said vertical plane (relative to the stepladder) and thus undesirably induce the ground pivotal of its legs 20*a*, 22*b* on the opposite side of the load-bearing studs 16, 18 and thus the possible downfall of the worker P.

Pedestal 40 may be of any desired width, which will enable its free engagement between the two studs 18, 20, e.g. precisely large enough for its lateral edges to slightly slidewisely engage the inner edges of these studs.

Advantageously, the pedestal 40 comprises on its upper surface a layer 48 of antiskid material, e.g. an elastomeric material, so as to firmly hold in place the feet D of an upright person standing on the platform.

Figure 6:
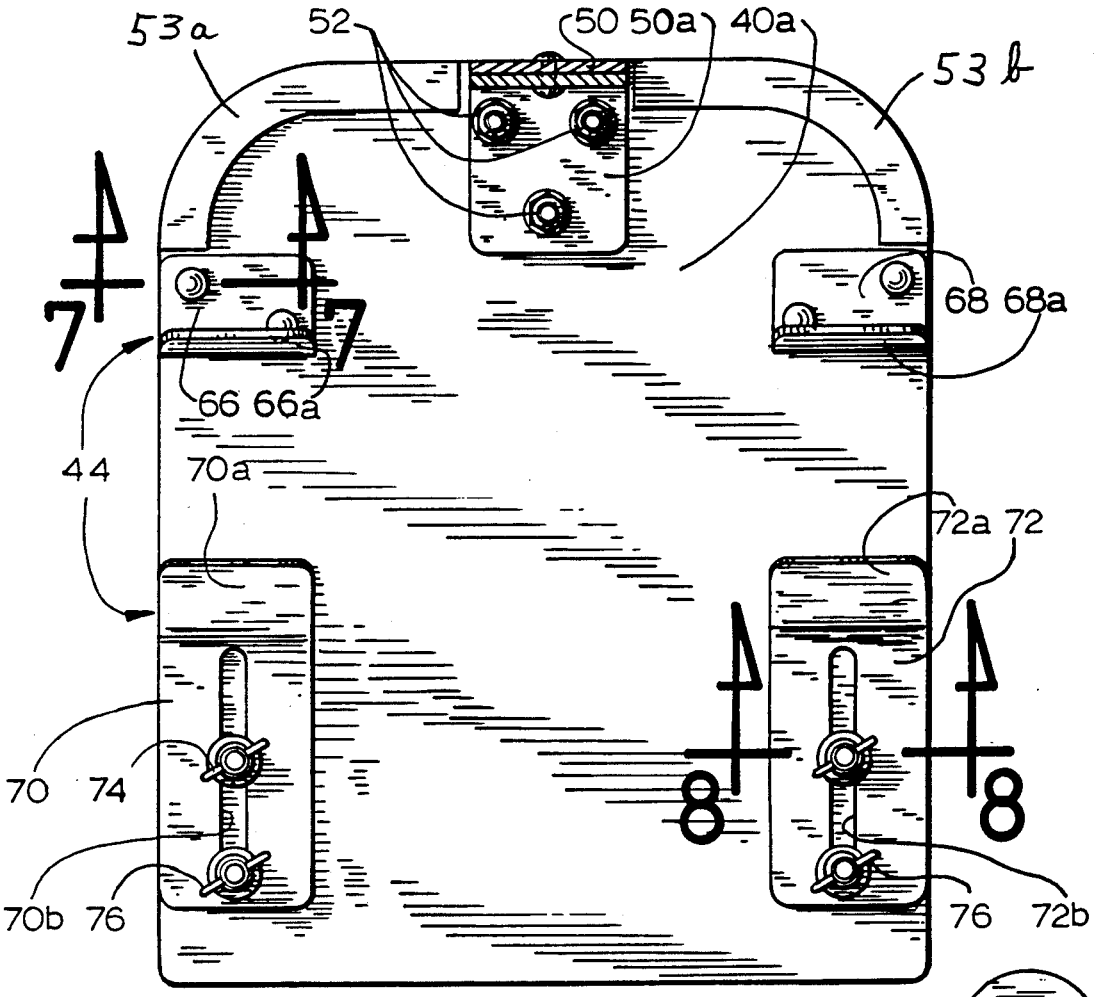
FIG. 6 is a bottom plan view of the main panel of the pedestal or platform, taken along section 6—6 of FIG. 4.
Figure 7:
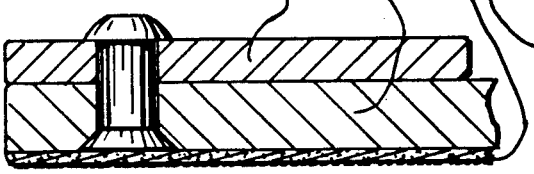
FIGS. 7–8 are transverse sectional views, at an enlarged scale, along lines 7—7 and 8—8 respectively of FIG. 6.
Figure 8:
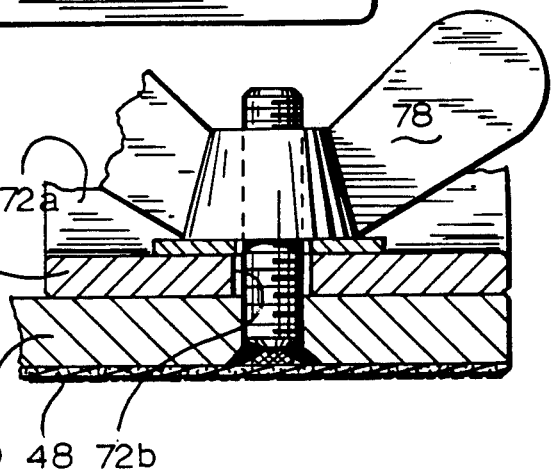

The anchoring means 42, illustrated in FIGS. 3–6, is designed to hook the pedestal 40 to its step 24*a*, while the anchoring means 44, illustrated in FIGS. 6–8, is designed to prevent sliding motion of the pedestal 40 over its step 24*a* through the plane of the load-bearing studs 20, 22.

The anchoring member 42 comprises a first, narrow, bar 50, being right-angle arcuate to form an [at its two ends 50*a*, 50*b*. The upper end 50*a* is anchored by bolts 52 to the lower face 40*a* of the panel 40, about its rear flange approximately in its middle. The lower end 50*b* of the bar 50 flatly abuts against the top face of a lower step 24*b*, e.g. the one 24*b* immediately beneath the step 24*a* supporting the panel 40 and, advantageously, centrally of this step 24*b*. The bar 50 should be narrow enough so as not to be prejudicial to a person p ascending or descending each of the steps including positioning his feet D on the step 24*b* sidewisely of this bar.

Advantageously, the inner (front) end of the lower portion 50*b* is slightly upwardly curved, at 50*c* (FIG. 3). Preferably, an additional, narrow, reinforcing bar 52 fixedly interconnects flange 50*c* with an intermediate section of bar 50, through e.g. riveting securing means Another narrow, L-shape bar 54 is adapted to abut by its lower leg 54*b* against the lower face of the step 24*b* and by its upper leg 54*a* onto the outer (rearward) face of the bar 50. The upper leg 54*a* of the bar 54 comprises a longitudinal slit 56, and the bar 50 comprises a through-bore 58 (FIG. 5) proximate its lower portion 50*b*, wherein a bolt 60 may engage the through-bore and slide through the slit and thus render bars 50, 54 integral through screwing action on the nut 62.

Advantageously, a bored slider 64 retained to the bar 50 bears the bolt 60 which extends therethrough, outwardly of the bar section 54*a*. The bolt 60 preferably comprises an integral O-ring spacer 66, abutting directly against the slider 64.

The inner ends of the bars 52, 54 may also be upwardly curved, similarly to end 50*c*.

Thus, one may, by moving the slider 64 along the bar section 54*a*, adjust the spacing between the bar sections 50*b* and 54*b*, in relation to the thickness of the step 24*b* positioned therebetween, and then, by tightening screw 60, render bar sections 50*b*, 54*b* integral to the step 24*b*, and therefore, the panel 40 integral to the stepladder 12.

The anchoring member 44 comprises four small plates 66, 68, 70 and 72, mounted to the lower face 40*a* of the panel 40. The small pates 66, 68 are fixedly secured, e.g. by riveting, to the two nearby side edges, outwardly of the panel i.e. proximate to the plate section 50*a*. The elongated small plates 70, 72 each comprises a lengthwise slit 70*b*, 72*b* through which extend two spaced bolts 74, 76 anchored to the panel 40, proximate to the two side edges, inwardly of the panel and in register with the small plates 66, 68, respectively, so that the small plates 70, 72 may slide parallel to each other when the bolts are loose. Wing nuts 78 permit the screwing of bolts 74, 76 against the small plates 70, 72 and thus render same integral to the panel 40. The inner flange of the small plates 66–72, at 66*a*–72*a*, is advantageously transversely curved, e.g. by a small obtuse angle for flanges 66*a*, 68*a* of the fixed small plates 66, 68 and by a large acute angle for the flanges 70*a*, 72*a* of the movable small plates 70, 72, so as to be able to abut flatly against the two opposite inner and outer faces of the parallelelipede 24*a* (FIG. 3).

Thus, by positioning the panel over the step 24*a* so that the latter extends in between the small plates 66–68 and 70–72, the panel may be made integral to this step by adjustably sliding the movable small plates 70, 72, against the step, then by screwing bolts 74, 76, to lock the whole in position. The panel is then prevented from sliding over the rung 24*a*, through the plane of the ladder part 14. The device 12 will therefore adjust to steps of different widths, thanks to the movable plates 70, 72.

The device 12, including its anti-skid surface 48, may be made from a rigid, sturdy material, e.g. of the metallic or rigid plastic type.

When installed on the rungs 24*a*, 24*b* of a stepladder, the device may accordingly with the invention remain thereon in the operative as well as inoperative position of the stepladder: indeed, the load-bearing legs 16, 18 being spaced, the way is clear for the device 12 when the stepladder is closed, i.e. there is no contra-indication for the device 12 remaining connected to the rungs once the stepladder is closed for transportion or storing, i.e. when the legs 16, 18 are pivoted about their hinge axes 28 to come to lengthwisely abut directly against the studs 20, 22.

I claim:

1. A stepladder capable of standing on the ground in an upright, well-balanced position and comprising a rigid frame and a series of cross-piece rungs anchored to the frame so as to be spaced from each other and substantially parallel to each other and so as to define a forwardly upwardly inclined plane forming a large acute angle relative to the ground, said stepladder comprising a large platform supported by an intermediate rung or step and extending through said rungs plane so as to project on the forward side as well as on the rearward side of said rung plane, releasable anchoring means to fixedly secure said platform to said intermediate step and to a rung beneath said intermediate step so that the platform the horizontal in the said upright position of the stepladder; wherein a person may freely ascend on or descend from each of the rungs of the upright stepladder, even when the platform is installed, and wherein this person may stand on the platform with his feet on the forward side or the rearward side of said rung plane, in total safety, wherein the working area of this person will be maximized and the balance of the stepladder, made firm; said anchoring means of the platform comprising adjustment means, to adapt to rungs or steps of variable height or thickness; wherein each step is cross-sectionally quadrangular and wherein said anchoring means comprises a first rigid bar, defining a main section endwisely curved at right angle to form an [, and anchored by its upper flange to the end of the platform opposite the inclination of the steps plane, and freely standing by its lower flange against the upper face of said lower step, and a second, L-shape, rigid bar, defining a first leg hooked by a slider to said first bar so as to be slidable therealong, and a second leg abuttable against the underface of said lower step, and locking means to render the slider integral to said two bars.

2. A stepladder as defined in claim 1, wherein said anchoring means further comprises a first pair of abutment members, secured to the lower face of said platform, on its opposite sides and proximate to the anchoring of said first bar, a second pair of abutment members, mounted to said lower face of said platform respectively in register with said first pair of abutment members, slider means to permit sliding motion of said second abutment members axially of said first abutment members in respective register, wherein said intermediate step may extend in between said first and second abutment members, and locking means to lock said second abutment members in position when the intermediate step is taken in sandwich between the abutment members.

3. A supporting device to improve the working area and the balance of a person using a ladder maintained in a forwardly, upwardly inclined, operative position above ground, said ladder consisting of two rigid studs, interconnected by a plurality of spaced, cross-piece rungs; said device comprising a large flat panel, capable of extending through the plane of said ladder on a forward side as well as on a rearward side of said plane, between the studs and to flatly abut against the top of an intermediate rung of said ladder, first anchoring means to frictionally, releasably, fixedly secure said panel about a horizontal plane in said operative ladder position, and second anchoring means frictionally releasably acting on said panel to prevent sliding motion of said panel within its said horizontal plane; wherein said device permits said person to stand upright on said panel, by positioning his feet on the side of the inclination as well as on the side opposite the inclination of the ladder plane, in utmost security; said rungs constituting steps each having a flat upper surface; said panel anchoring means comprising adjustment means, to adapt to steps of variable thickness or height; wherein each step is cross-sectionally quadrangular and wherein said first anchoring means comprises a first rigid bar, defining a main section endwisely curved at right angle to form an [, and anchored by its upper flange to the end of the panel opposite the inclination of the steps plane, and freely standing by its lower flange against the upper face of a step beneath said intermediate step, and a second rigid L-shape bar, having a first leg retained by a slider against said first bar so as to be able to slide therealong, and a second leg capable of abutting against the top face of said lower step, and locking means to render the slider integral to the two bars.

4. A supporting device as defined in claim 3, wherein said second anchoring means comprises a first pair of abutment members, fixedly secured to the lower face of said panel, on its opposite sides and proximate to the anchoring of said first bar, a second pair of abutment members, mounted on said lower face of said panel respectively in register with said first pair of abutment members, slider means to permit sliding motion of said second abutment members axially of said first registering abutment members, wherein said intermediate step may extend in between said first and second abutment members, and locking means to lock said second abutment members in position when the intermediate step is taken in sandwich between the abutment members.

5. A stepladder capable of standing on the ground in an upright, well-balanced position and comprising a rigid frame and a series of cross-piece rungs anchored to the frame so as to be spaced from each other and substantially parallel to each other and so as to define a forwardly upwardly inclined plane forming a large acute angle relative to the ground, said stepladder comprising a large platform supported by an intermediate rung or step and extending through said rungs plane so as to project on the forward side as well as on the rearward side of said plane, releasable anchoring means to fixedly secure said platform to said intermediate step and to a lower rung beneath said intermediate step so that the platform be horizontal in the said upright position of the stepladder; wherein a person may freely ascend on or descend from each of the rungs of the upright stepladder, even when the platform is installed, and wherein this person may stand on the platform with his feet on said forward side or said rearward side of said rung plane, in total safety, wherein the working area of this person will be maximized and the balance of the stepladder, made firm; each step being cross-sectionally quadrangular and said anchoring means comprising a vertically extending, rigid, support bar, anchored at its top end to the rearward end of said platform, and a cross-sectionally U-shape member, fixedly secured to the bottom end of said vertical support bar and releasably engaging said lower rung; wherein said U-shape member extends transversely through said forwardly upwardly inclined rung plane, in a generally fore to rear horizontal direction substantially at right angle to said vertically extending support bar; and locking means, to releasably lock said U-shape member to said lower step supporting said support bar.

* * * * *